United States Patent [19]

Smith

[11] 4,361,996

[45] Dec. 7, 1982

[54] CEILING RENOVATION SYSTEM

[75] Inventor: Robert L. Smith, Samsonville, N.Y.

[73] Assignee: Levolor Lorentzen, Inc., Hoboken, N.J.

[21] Appl. No.: 105,609

[22] Filed: Dec. 20, 1979

[51] Int. Cl.[3] ..... E04B 5/52

[52] U.S. Cl. ..... 52/484; 52/489; 52/514; 52/714; 52/762

[58] Field of Search ..... 52/489, 484, 762, 514, 52/714

[56] References Cited

U.S. PATENT DOCUMENTS

| | | | |
|---|---|---|---|
| 3,058,172 | 10/1962 | Phillips | 52/145 |
| 3,277,622 | 10/1966 | Jensen | 52/762 X |
| 3,295,284 | 1/1967 | Tschiesche | 52/484 X |
| 3,553,915 | 1/1971 | Passovoy | 52/489 X |
| 3,807,114 | 4/1974 | Ollinger | 52/489 |
| 3,871,150 | 3/1975 | Murray et al. | 52/489 |
| 4,157,000 | 1/1979 | Sutter | 52/489 |

FOREIGN PATENT DOCUMENTS

| | | | |
|---|---|---|---|
| 248433 | 12/1963 | Australia | 52/484 |
| 854243 | 11/1960 | United Kingdom | 52/484 |

*Primary Examiner*—Alfred C. Perham

[57] ABSTRACT

A renovation profile, for covering an exposed T-bar of a suspended ceiling. The profile has a substantially U-shaped cross-section, can be placed around the head of the T-bar, and has sets of spaced tabs for supporting ceiling panels.

1 Claim, 5 Drawing Figures

CEILING RENOVATION SYSTEM

BACKGROUND OF THE INVENTION

The present invention relates to ceilings and more specifically to a system for renovating old and stained or soiled ceilings quickly and inexpensively by covering the same with ceiling panels.

The system according to the present invention makes use of the basic structure of a suspended ceiling. Such suspended ceilings usually comprise a grid system of T-bars arranged at right angles and suspended by support wires. The free spaces between the intersecting grid of T-bars are filled with ceiling tiles. These tiles over time become soiled and stained. In order to renovate the ceiling it is necessary to remove the old ceiling tiles and to replace them with new ones, but soiled and discolored T-bars remain visible.

It is an object of the invention to avoid the necessity of replacing the tiles.

According to the present invention the old tiles may be removed or they may remain in place wherein they will provide additional accoustical and/or insulating values. The downwardly facing surfaces of the T-bars running in one and the same direction are fitted with strips of a renovation profile which is provided with tabs adapted to receive ceiling panels. Such panels are well known in the art and may have any desired shape, such as triangular or U-shaped.

BRIEF DESCRIPTION OF THE DRAWINGS

The invention is described in greater detail in connection with the accompanying drawings in which.

DETAILED DESCRIPTION OF A PREFERRED EMBODIMENT

Figure 1:
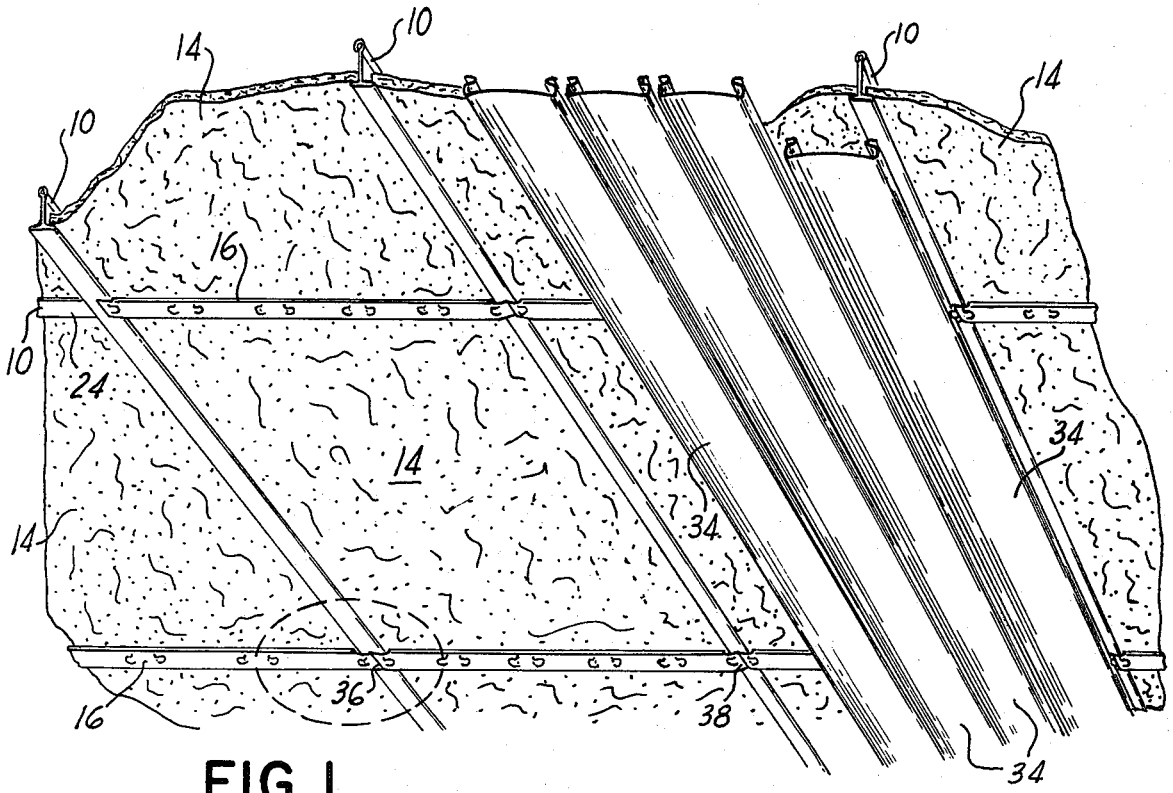
FIG. 1 is a bottom perspective view of a suspended ceiling shown on the left and right-hand sides an old ceiling provided with the renovation profile of the present invention, and in the center the ceiling covered with ceiling panels.
Figure 2:
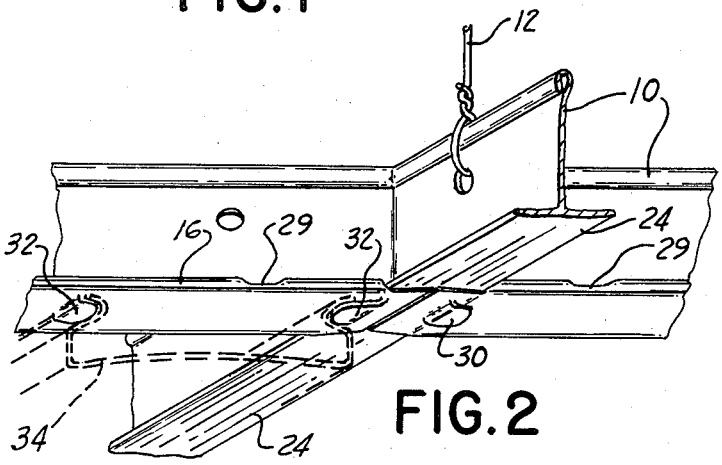
FIG. 2 is a perspective view of an intersection of T-bars, such as the intersection encircled in FIG. 1 and provided with the renovation profile.
Figure 5:
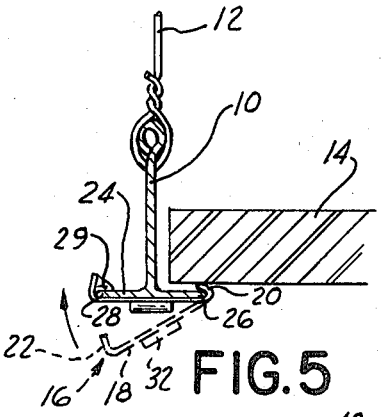
FIG. 5 is a section through a portion of the suspended ceiling showing how the renovation profile is attached to a T-bar.
Figure 3:
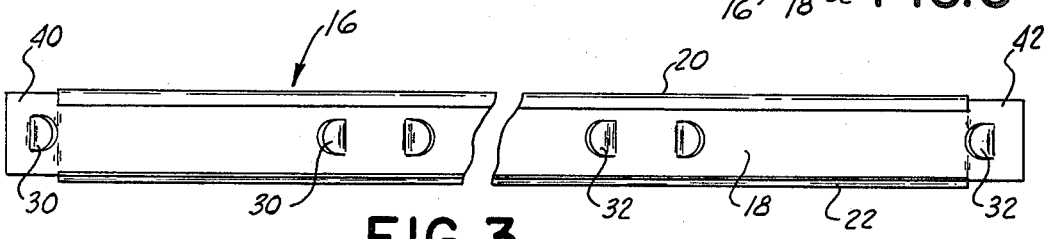
FIGS. 3 and 4 are, respectively, a top and side view of the renovation profile.
Figure 4:
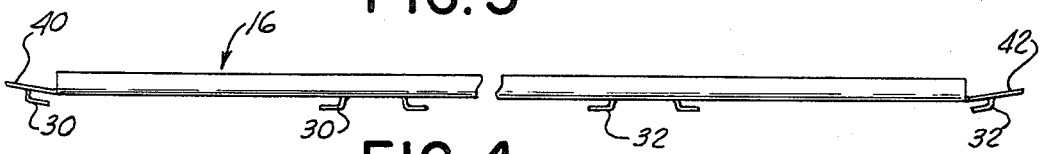

The suspended ceiling illustrated in the drawings comprises a grid of T-bars 10 that are common in the construction trade. Only four intersections of such T-bars are illustrated in FIG. 1, but it is understood that there are a large number of such intersections wich form a complete grid over the expense of an entire ceiling of a room. The grid of T-bars 10 is suspended by a number of cables 12 from a structural ceiling of the building or the like. Usually, the spaces between intersecting T-bars are filled with tiles 14. When these tiles, and possibly the T-bars also, become soiled the ceiling can be renovated quickly and inexpensively by attaching renovation strips 16 to parallel rows of T-bars 10. Each profile 16 has an essentially U-shaped cross-section, as clearly shown in FIGS. 3 and 5, including a main body portion 18, a first leg portion 20 and a parallel second leg portion 22. Leg portion 20 is bent inwardly so that it may easily hook around one edge 26 of the head 24 of a T-bar, whereas the leg portion 22 extends essentially vertically, i.e., at a right angle to main body portion 18. In this way, the profile 16 may be swung about edge 26 of a T-bar until it passes around the opposite edge 28 of the T-bar, as shown in full lines in FIG. 5. Thereafter, the leg portion 22 may be bent downwardly in several places such as at 29 in FIG. 2, for instance, with a pair of pliers, so that the entire profile becomes fixed to the respective T-bar. The central portion 18 is provided with sets of tabs, only two complete sets 30 and 32 being shown in FIGS. 3 and 4. From these tabs ceiling panels 34 may be suspended as shown in the center of FIG. 1. Such ceiling panels are well known in the art, and are shown, for instance, in U.S. Pat. No. 3,366,029. The profiles are manufactured in appropriate lengths, such as 2 feet, to cover the distance between the centers of two parallel T-bars 10, such as between centers 36 and 38 in FIG. 1. In this connection, each profile 16 has two end portions 40 and 42, respectively, each having a length of approximately one half the width of head 24 of T-bar 10. At these end portions 40 and 42, the leg portions 20 and 22 are missing. End portions 40 and 42 point slightly inwardly as clearly evident in FIG. 4. Once they are placed on the respective head 24 they are bent down by such head 24. If the T-bars should cross each other at irregular intervals, the renovation profile 16 can easily be adapted to this situation by cutting out or notching a section of the leg portions 20 and 22 of the renovation profile in order to clear the T-bar.

I claim:

1. In combination with a suspended ceiling: a grid of interconnected T-bars including parallel rows of T-bars extending in a first direction, and parallel rows of T-bars extending in a second direction substantially perpendicular to said first direction and intersecting said first row of T-bars, said rows of T-bars having exposed head surfaces, and a plurality of covers affixed to and covering the exposed head surfaces of one of said parallel rows of T-bars, each of said covers being a metallic body substantially of U-shaped cross-section with a main body portion engaging with an exposed head surface of a T-bar of said one parallel row of T-bars, and with first and second parallel leg portions, respectively extending at an acute and a right angle with respect to said main body portion and engaging with opposite edges of said exposed head surface, portions of said second leg portions being depressed into clamping engagement with said T-bar, a plurality of sets of spaced tabs at each of said main body portions, and a plurality of ceiling panels, respectively suspended from said covers by respective ones of said sets of tabs.

* * * * *